US007830350B2

(12) United States Patent
Joo

(10) Patent No.: US 7,830,350 B2
(45) **Date of Patent: *Nov. 9, 2010**

(54) DISPLAY PANEL DRIVING DEVICE, DISPLAY APPARATUS AND METHOD OF DRIVING THE SAME

(75) Inventor: Soong-Yong Joo, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 96 days.

This patent is subject to a terminal disclaimer.

(21) Appl. No.: 12/103,583

(22) Filed: Apr. 15, 2008

(65) Prior Publication Data

US 2008/0191992 A1 Aug. 14, 2008

Related U.S. Application Data

(63) Continuation of application No. 10/869,861, filed on Jun. 18, 2004, now Pat. No. 7,375,717.

(30) Foreign Application Priority Data

Sep. 30, 2003 (KR) ..... 2003-067852

(51) Int. Cl.
*G09G 3/36* (2006.01)

(52) U.S. Cl. ..... 345/99; 345/95

(58) Field of Classification Search ..... 345/87, 345/94, 95, 98, 99, 100, 211, 212, 214
See application file for complete search history.

(56) References Cited

U.S. PATENT DOCUMENTS

| | | | | |
|---|---|---|---|---|
| 5,585,744 | A * | 12/1996 | Runas et al. | 326/86 |
| 5,644,255 | A * | 7/1997 | Taylor | 326/81 |
| 5,945,970 | A * | 8/1999 | Moon et al. | 345/92 |
| 6,686,899 | B2 * | 2/2004 | Miyazawa et al. | 345/100 |
| 6,903,734 | B2 * | 6/2005 | Eu | 345/211 |
| 6,961,034 | B2 * | 11/2005 | Kusanagi | 345/87 |
| 7,068,076 | B2 * | 6/2006 | Azami | 326/83 |

* cited by examiner

*Primary Examiner*—Ricardo L Osorio
(74) *Attorney, Agent, or Firm*—F. Chau & Associates, LLC

(57) ABSTRACT

A display panel for driving a display panel in response to data and gate signals, includes first and second switching sections, a timing control section, a driving voltage generating section, a gate driving section and data driving section. The first switching section switches a source voltage in response to a first switching signal. The timing control section outputs a gate control signal and a data control signal in response to the source voltage. The driving voltage generating section receives the source voltage to output first, second and third driving voltages. The second switching section switches the first, second and third driving voltages. The gate driving section outputs the gate signals in response to the first and second driving voltages. The data driving section outputs the data signals in response to the third driving voltage. The display panel eliminates a noise generated when an electric power is off.

18 Claims, 7 Drawing Sheets

DISPLAY PANEL DRIVING DEVICE, DISPLAY APPARATUS AND METHOD OF DRIVING THE SAME

CROSS-REFERENCE TO RELATED APPLICATIONS

This application is a continuation of U.S. patent application Ser. No. 10/869,861, filed on Jun. 18, 2004, now U.S. Pat. No. 7,375,717, which claims priority to Korean Patent Application No. 2003-67852, filed on Sep. 30, 2003, the disclosures of which are incorporated by reference herein in their entirety.

BACKGROUND OF THE INVENTION

1. Field of the Invention

The present invention relates to a display panel driving device, a display apparatus and a method of driving the display apparatus, and more particularly to display panel driving device for eliminating a noise generated when an electric power is off, a display apparatus having the display panel driving device, and a method of driving the display apparatus.

2. Description of the Related Art

Generally, a liquid crystal display apparatus includes a liquid crystal display panel, a gate driving circuit and a data driving circuit. The liquid crystal display panel includes a plurality of gate lines and a plurality of data lines. The gate driving circuit provides the gate lines with a gate driving signal, and the data driving circuit provides the data lines with an image signal. The gate and data driving circuits are formed as chips mounted on the liquid crystal display panel.

Recently, the gate driving circuit is formed on the liquid crystal panel directly to reduce a size and enhance productivity.

The gate driving circuit includes a shift register having a plurality of stages electrically connected with each other. The stages correspond to the gate lines respectively, so that outputs of the stages are applied to the gate lines respectively.

A size of the gate driving circuit increases as the size of the liquid crystal display panel increases. Thus, a resistivity and a parasitic capacitance increase, so that the gate driving circuit may not operate promptly according to an external signal.

Especially, when an electric power is off (or when a liquid crystal display apparatus is turned off), a voltage that is electrically charged in the gate driving circuit is not promptly discharged, so that a residue signal is outputted. In case of a transmissive type liquid crystal display apparatus, although the residue signal is outputted, an image is not displayed when a power that is applied to a backlight assembly is off. However, in case of a reflective type or a transmissive and reflective type liquid crystal display apparatus, the residue signal is outputted to display a noise.

SUMMARY OF THE INVENTION

The present invention provides a display panel driving device for eliminating a noise occurring, when an electric power is off.

The present invention also provides a liquid crystal display apparatus having the display panel driving device.

The present invention also provides a method of driving a liquid crystal display apparatus is provided.

In an exemplary display panel driving device of the present invention, the display panel driving device for driving a display panel in response to data and gate signals, includes first and second switching sections, a timing control section, a driving voltage generating section, a gate driving section and data driving section. The first switching section switches a source voltage in response to a first switching signal. The timing control section outputs a gate control signal and a data control signal in response to the source voltage. The driving voltage generating section receives the source voltage to output first, second and third driving voltages. The second switching section switches the first, second and third driving voltages. The gate driving section outputs the gate signals in response to the first and second driving voltages. The data driving section outputs the data signals in response to the third driving voltage.

In an exemplary display apparatus of the present invention, the display apparatus includes first and second switching sections, a timing control section, a driving voltage generating section, a gate driving section, a data driving section and a display panel. The first switching section switches a source voltage in response to a first switching signal. The timing control section outputs gate and data control signals in response to the source voltage switched by the first switching section. The driving voltage generating section generates first, second and third driving voltages by the source voltage. The second switching section switches the first, second and third driving voltage in response to the second switching signal. The gate driving section outputs gate signals in response to the first and second driving signals provided from the second switching section, and the gate control signal. The data driving section outputs data signal in response to the third driving voltage provided from the second switching section and the gate control signal. The display panel includes data and gate lines. The data signal is applied to the data line, and the gate signal is applied to the gate line to display an image through the display panel.

According to a method of driving a display panel in response to a data signal and a gate signal, a source voltage is switched in response to a first switching signal. A gate control signal and a data control signal are outputted in response to a control signal and the source voltage. First, second and third driving voltages are generated from the source voltage. The first, second and third driving voltages are switched in response to a second switching signal. Gate signal is outputted in response to the gate control signal, and the first and second driving signals. Then, data signal is outputted in response to the data control signal and the third driving signal.

According to the present invention, the first gate driving voltage that turns on the gate driving section drops to be the ground voltage at a point of time when the source voltage is cut off, and the second gate driving voltage that turns off the gate driving section is cut off and raised to be the ground voltage a few seconds (moments) later.

Thus, the noises occurring after the source voltage is cut off are removed.

BRIEF DESCRIPTION OF THE DRAWINGS

The above and other features and advantage points of the present invention will become more apparent by describing in detailed exemplary embodiments thereof with reference to the accompanying drawings, in which.

DESCRIPTION OF THE PREFERRED EMBODIMENTS

Hereinafter, the preferred embodiments of the present invention will be described in detail with reference to the accompanied drawings.

Embodiment 1

Figure 1:
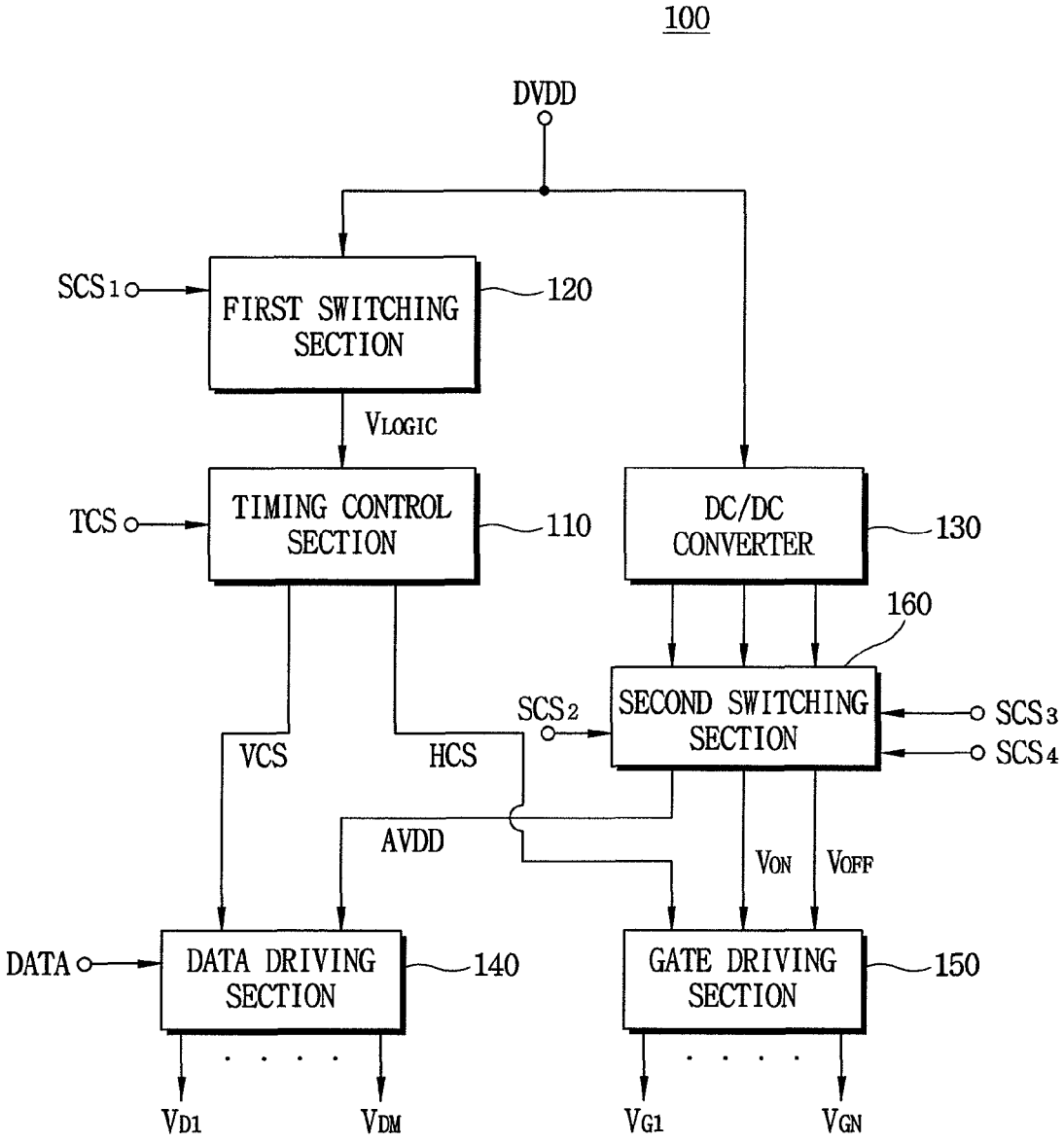
FIG. 1 is a block diagram showing a display panel driving device according to first exemplary embodiment of the present invention.

FIG. 1 is a block diagram showing a display panel driving device according to first exemplary embodiment of the present invention.

Referring to FIG. 1, a display panel driving device 100 according to a first exemplary embodiment of the present invention includes a timing control section (or control section) 110, a DC/DC converter (or driving voltage generating section) 130, a data driving section 140, a gate driving section 150, and first and second switching sections 120 and 160. The display panel driving device 100 receives an external source voltage DVDD, and the external source voltage DVDD is applied to the first switching section 120 and the DC/DC converter 130. The external source voltage DVDD corresponds to about 3.3V digital voltage.

The first switching section 120 controls the timing control section 110 to be turned off or turned on in response to a first switching signal SCS1. When the source voltage DVDD is cut off at a first time point (or first point in time), the first switching section 120 delays the source voltage DVDD from the first time point to a second time point (or second point in time) that is behind the first time point to turn on the timing control section 110 up to the second time point. Then, at the second time point, the timing control section 110 is turned off. The source voltage DVDD applied to the timing control section 110 corresponds to a logic voltage Vlogic.

The timing control section 110 outputs a horizontal control signal HCS and a vertical control signal VCS in response to a control signal TCS from an external device, and the logic voltage Vlogic from the first switching part. The control signal TCS includes the horizontal control signal HCS, the vertical control signal VCS and a main clock signal.

The vertical control signal VCS and the horizontal control signal HCS are applied to the data driving section 140 and the gate driving section 150, respectively.

The DC/DC converter 130 raises or lowers the source voltage DVDD to adjust fitting voltage level, and the DC/DC converter 130 converts the source voltage DVDD corresponding to a digital voltage into a data driving voltage AVDD corresponding to an analog voltage. Thus, the data driving voltage AVDD, and first and second gate driving voltages Von and Voff, which are outputted from the DC/DC converter 130, correspond to analog type. The first gate driving voltage Von is positive, and the second gate driving voltage Voff is negative.

The data driving voltage AVDD, and the first and second gate driving voltages Von and Voff are applied to the second switching section 160. The second switching section 160 switches the first and second gate driving voltages Von and Voff in response to second, third and fourth switching signal SCS2, SCS3 and SCS4.

The second switching section 160 transfers the first and second gate driving voltages Von and Voff to the gate driving section 150 in response to the third and fourth switching signals SCS3 and SCS4, or the second switching section 160 cuts off the first and second driving voltages Von and Voff.

Thus, a third time point when the first gate driving voltage Von is cut off is advanced prior to a second time point when the logic voltage Vlogic is cut off, a fourth time point when the second gate driving voltage Voff is delayed next to the second time point.

Figure 2:
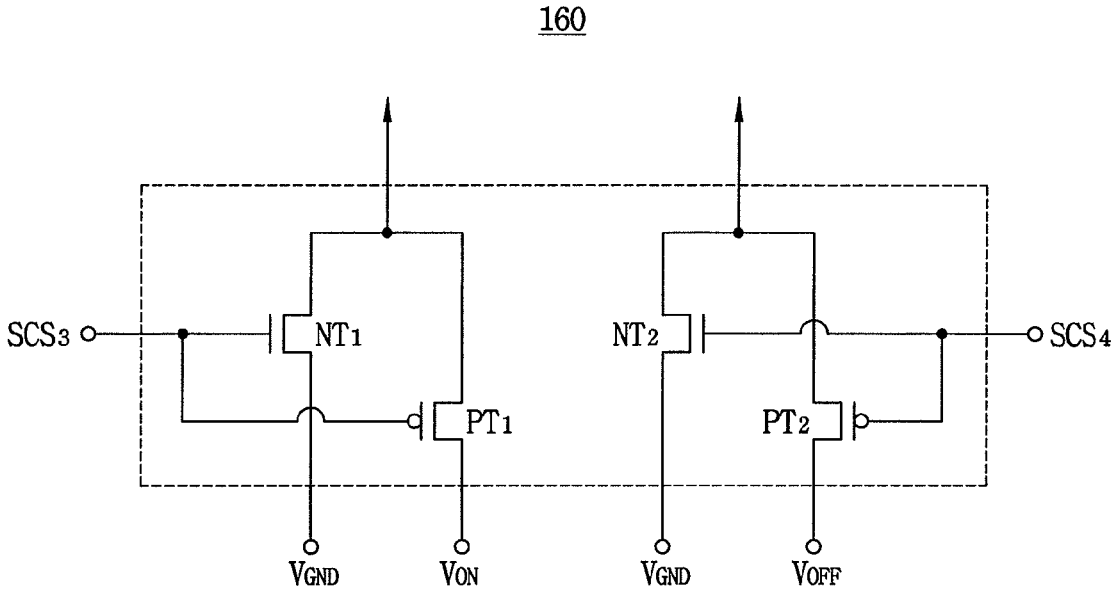
FIG. 2 is a circuit diagram showing a switching section of FIG. 1.

FIG. 2 is a circuit diagram showing a switching section of FIG. 1.

Referring to FIGS. 1 and 2, a second switching section 160 includes first and second PMOS transistors PT1 and PT2, and first and second NMOS transistor NT1 and NT2. The first PMOS and NMOS transistors PT1 and NT1 switch a first gate driving signal Von. The second PMOS and NMOS transistors PT1 and NT1 switch a second gate driving signal Voff.

The first PMOS transistor PT1 includes a source electrode that is electrically connected to the first gate driving voltage Von, a gate electrode that is electrically connected to the third switching signal SCS3, and a drain electrode that is electrically connected to the gate driving section 150.

The first NMOS transistor NT1 includes a source electrode that is electrically connected to the ground voltage Vgnd, a gate electrode that is electrically connected to the third switching signal SCS3, and a drain electrode that is electrically connected to the drain electrode of the first PMOS transistor PT1.

The first PMOS transistor PT1 is turned off in response to the third switching signal SCS3 that is changed to be high level at particular time point. Thus, the second switching part 160 outputs the ground voltage Vgnd instead of the first gate driving signal Von. Then, the ground voltage Vgnd is applied to the gate driving section 150. The point of time when the second switching section 160 outputs the ground voltage Vgnd will be explained referring to FIG. 4.

The second PMOS transistor PT2 includes a source electrode that is electrically connected to the second gate driving voltage Voff, a gate electrode that is electrically connected to the fourth switching signal SCS4, and a drain electrode that is electrically connected to the gate driving section 150.

The second NMOS transistor NT2 includes a source electrode that is electrically connected to the ground voltage Vgnd, a gate electrode that is electrically connected to fourth switching signal SCS4, and a drain electrode that is electrically connected to the drain electrode of the second PMOS transistor PT2.

The second PMOS transistor PT2 is turned off in response to the fourth switching signal SCS4 that is changed to be high level at particular time point. Thus, the second switching part 160 outputs the ground voltage Vgnd instead of the second gate driving signal Voff. Then, the ground voltage Vgnd is applied to the gate driving section 150. The point of time when the second switching section 160 outputs the ground voltage Vgnd will be explained referring to FIG. 4.

In FIG. 2, the second switching part 160 includes PMOS and NMOS transistors. However, other switching devices may be used for the second switching part 160.

Referring again to FIG. 1, the data driving part 140 transforms image signal provided from an external device to output data signals Vd1 to Vdm, in response to the data driving voltage AVDD and the vertical control signal VCS.

Figure 3:
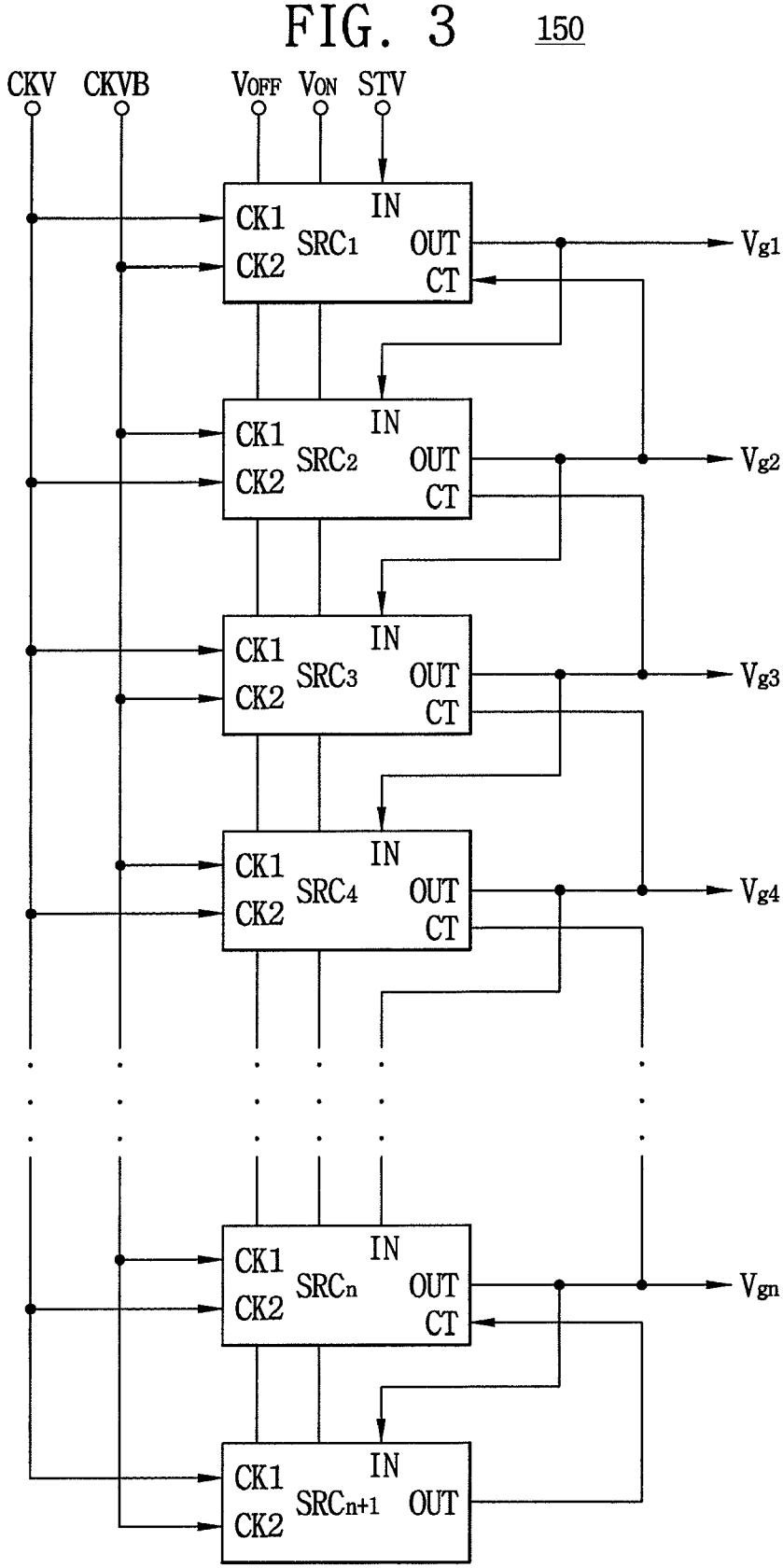
FIG. 3 is a schematic diagram showing a gate driving section of FIG. 1.

FIG. 3 is a schematic diagram showing a gate driving section of FIG. 1.

Referring to FIGS. 1 and 3, the gate driving section 150 outputs gate signal in response to the horizontal control signal HCS, and first and second gate driving voltages Von and Voff.

The gate driving section 150 includes (n+1)-number of stages SRC1 to SRCn+1 electrically connected with each other. The first gate driving voltage Von turns on each of the stages SRC1 to SRCn+1, and the second gate driving voltage Voff turns off each of the stages SRC1 to SRCn+1.

Generally, each of the stages SRC1 to SRCn+1 includes a plurality of NMOS transistors (not shown) and capacitor. Thus, the first gate driving signal Von that turns on the stages SRC1 to SRCn+1 is positive, and the second gate driving signal Voff that turns off the stages SRC1 to SRCn+1 is negative.

The horizontal control signal HCS includes first and second clock signals CKV and CKVB, and start signal STV. The first and second clock signals CKV and CKVB have reversed phase with each other.

The n number of stages SRC1 and SRCn is turned on successively in response to the horizontal control signal HCS, and the first and second gate driving signals Von and Voff.

Figure 4:
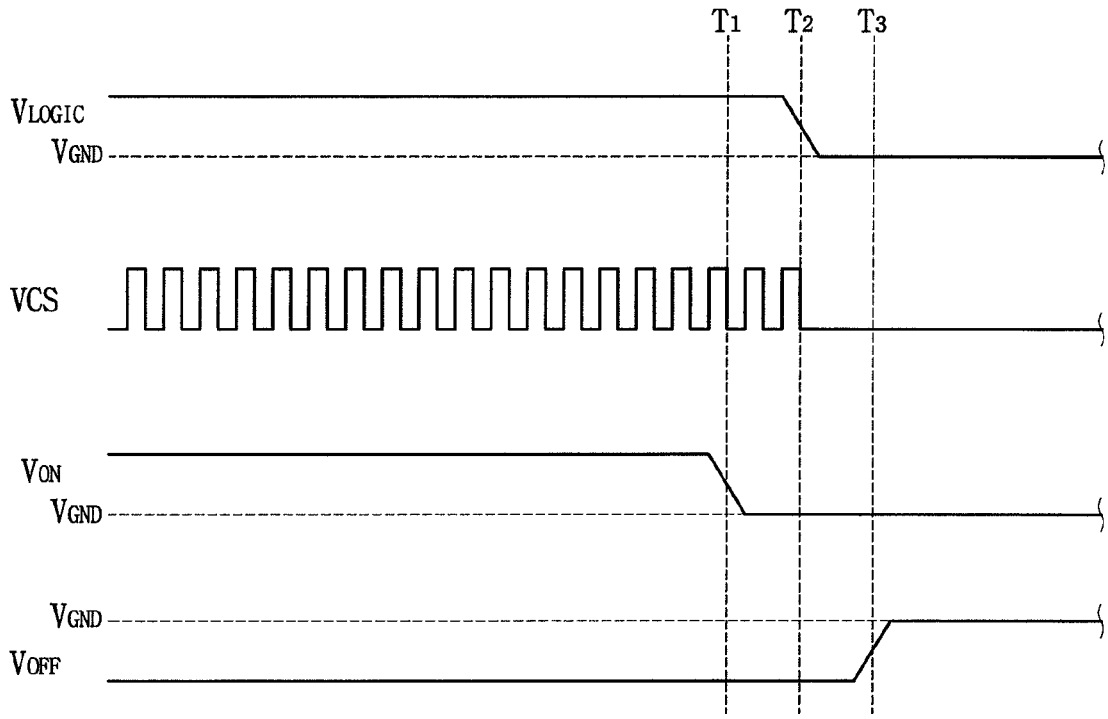
FIG. 4 is waveforms showing outputs of first and second switching sections of FIG. 1.

FIG. 4 is waveforms showing outputs of first and second switching sections of FIG. 1.

Referring to FIG. 4, the logic voltage Vlogic is lowered to be the ground voltage Vgnd at a second time point T2 that is delayed next to a first time point T1 at which the source voltage DVDD is cut off.

The timing control section 110 is turned off in response to the logic voltage Vlogic that is lowered to be the ground voltage Vgnd at the second time point T2, so that the timing control section 110 does not output the vertical control signal VCS any more. The data driving section 140 is turned off at a time point at which the timing control section 110 stops outputting the vertical control signal VCS, so that the data driving section does not output the data signals Vd1 to Vdm any more.

The first gate driving voltage Von drops to be the ground voltage Vgnd at the first time point T1 at which the source voltage is cut off. That is, the first gate driving voltage Von drops at the first time point T1 prior to the second time point T2 at which the logic voltage Vlogic drops. Further, the second gate driving voltage Voff is raised to be the ground voltage Vgnd at a third time point T3 next to the second time point T2.

The first gate driving voltage Von drops to be the ground voltage Vgnd at the first time point T1, so that turned on stages of the gate driving section 150 are being turned off slowly after the first time point T1.

The second gate driving voltage Voff maintains a voltage that is set until the third time point T3, so that the turned on stages is turned off easily due to the second gate driving voltage Voff. Thus, all stages SRC1 to SRCn of the gate driving section 150 are turned off easily before the second time point T2 at which the data driving section 140 is turned off.

In FIG. 4, each of the stages of the gate driving section 150 includes NMOS transistor. Thus, the first gate driving voltage Von has a positive polarity and the second gate driving voltage has a negative polarity. However, each of the stages may include PMOS transistors. Then, the first gate driving voltage Von has a negative polarity, whereas the second gate driving voltage has a positive polarity.

Embodiment 2

Figure 5:
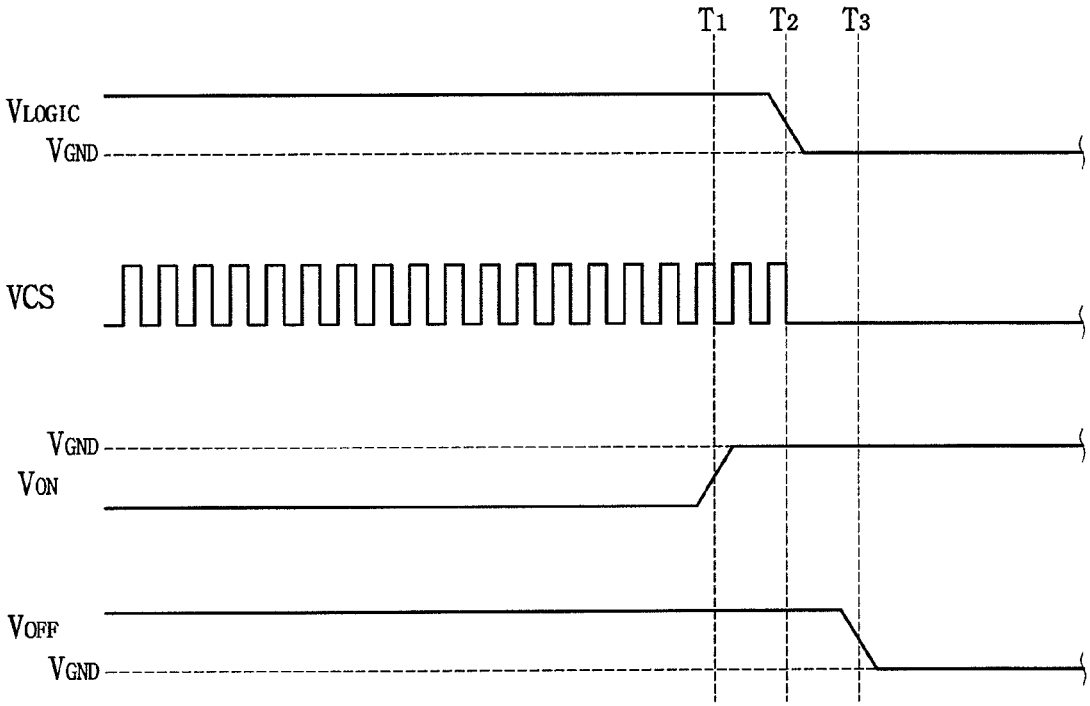
FIG. 5 is waveforms showing outputs of first and second switching sections according to a second exemplary embodiment of the present invention.

FIG. 5 is waveforms showing outputs of first and second switching sections according to a second exemplary embodiment of the present invention. The waveforms correspond to outputs of the first and second switching sections including a plurality of stages having PMOS transistors.

Referring to FIGS. 1, 3 and 5, the first gate driving voltage Von is raised to be a ground voltage Vgnd at a first time point T1 at which a source voltage is cut off. That is, the first gate driving voltage Von is raised to be the ground voltage Vgnd at the first time point T1 prior to a second time point T2 at which a logic voltage Vlogic drops. A second gate driving voltage Voff having positive voltage drops at a third time point T3 next to the second time point T2. The first gate driving voltage Von turns on each of the stages of the gate driving section 150, and the second gate driving voltage Voff turns off each of the stages of the gate driving section 150.

The first gate driving voltage Von is raised to be the ground voltage Vgnd at the first time point T1, so that turned on stages of the gate driving section 150 are being turned off slowly after the first time point T1.

The second gate driving voltage Voff maintains a voltage that is set until the third time point T3, so that the turned on stages are turned off easily due to the second gate driving voltage Voff. Thus, all stages SRC1 to SRCn of the gate driving section 150 are turned off easily, before the second time point T2 at which the data driving section 140 is turned off.

Embodiment 3

Figure 6:
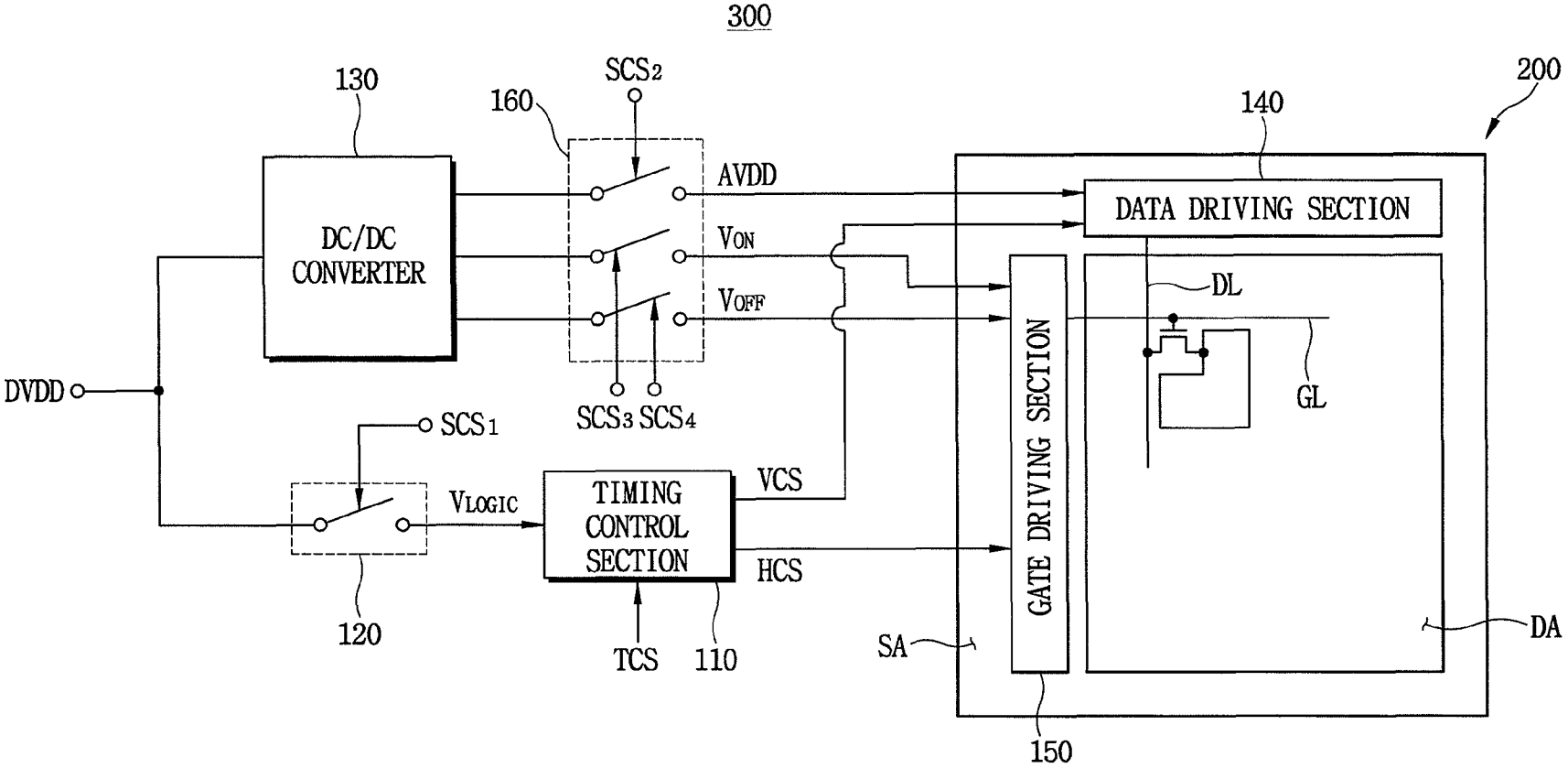
FIG. 6 is a block diagram showing a liquid crystal display apparatus according to a third exemplary embodiment of the present invention.

FIG. 6 is a block diagram showing a liquid crystal display apparatus according to a third exemplary embodiment of the present invention. The liquid crystal display apparatus of the present embodiment includes the display panel driving device that is same as in Embodiment 1. Thus, the same reference numerals will be used to refer to the same or like parts as those described in Embodiment 1 and any further explanation will be omitted.

Referring to FIG. 6, a liquid crystal display apparatus according to a third exemplary embodiment of the present invention includes a liquid crystal display panel 200 for displaying an image, and a display panel driving device 100 for driving the liquid crystal display panel 200.

The liquid crystal display panel 200 includes first and second substrates, and a liquid crystal layer interposed between the first and second substrates. The liquid crystal panel 200 includes a display region DA for displaying an image, and a peripheral region SA that is disposed adjacent to the display region DA.

The display region DA includes a plurality of gate lines GL, and a plurality of data lines DL. The gate lines GL are substantially perpendicular to the data lines DL. A thin film transistor 210 includes a gate electrode that is electrically connected to the gate line GL, a source electrode that is electrically connected to the data line DL, and a drain electrode that is electrically connected to a pixel electrode 220.

The display panel driving device 100 includes a timing control section 110, a DC/DC converter 130, a gate driving section 150, a data driving section 140, and first and second switching sections 120 and 160.

The first switching section 120 switches a source voltage DVDD to turn on or off the timing control section 110, in response to a first switching signal SCS1. The timing control section 120 outputs a horizontal control signal HCS and a vertical control signal VCS in response to a logic voltage Vlogic provided from the first switching section 120, and a control signal TCS provided from an external device.

The horizontal control signal HCS is applied to the gate driving section 150, and the vertical control signal VCS is applied to the data driving section 140.

The DC/DC converter 130 raises or lowers the source voltage DVDD to adjust a fitting level, and the DC/DC converter 130 converts the source voltage DVDD corresponding to a digital type to a data driving voltage AVDD that corresponds to an analog type.

The data driving voltage AVDD, first and second gate driving voltages Von and Voff are applied to the second switching section 160. The second switching section 160 switches the data driving voltage AVDD and the first and second gate driving voltages Von and Voff in response to second, third and fourth switching signals SCS2, SCS3 and SCS4.

The data driving section 140 converts a image signal provided from an external device to a data signal that is applied to the data lines DL, in response to the vertical control signal VCS and the data driving voltage AVDD.

The data driving section 140 is formed in a chip, so that the chip is mounted on the peripheral region SA of the liquid crystal display panel 200, and the chip is electrically connected to the data lines DL.

The gate driving section 150 provides the gate lines GL with gate signal in response to the first and second gate driving voltages Von and Voff. The gate driving section 150 is formed on the peripheral region SA via a same process through which the thin film transistor 210 is formed on the display region DA. The gate driving section 150 is electrically connected to the gate lines GL in the peripheral region SA. Thus, the gate signal outputted from the gate driving section 150 is applied to the gate lines GL.

When the gate signal is applied to the gate line GL, the thin film transistor 210 that is electrically connected to the gate line GL is turned on. Then, the data signal applied to the data line DL from the data driving section 140 is transferred to the pixel electrode 220 via the thin film transistor 210. Thus, the liquid crystal display panel 200 displays an image in response the gate and data signals provided from the gate driving section 100.

The gate driving section 100 discharges the data and gate signals applied to the liquid crystal display panel 200 promptly when the source voltage DVDD is cut off. Thus, the liquid crystal display panel 200 prevents the data and gate signals from being outputted as a noise.

Figure 7:
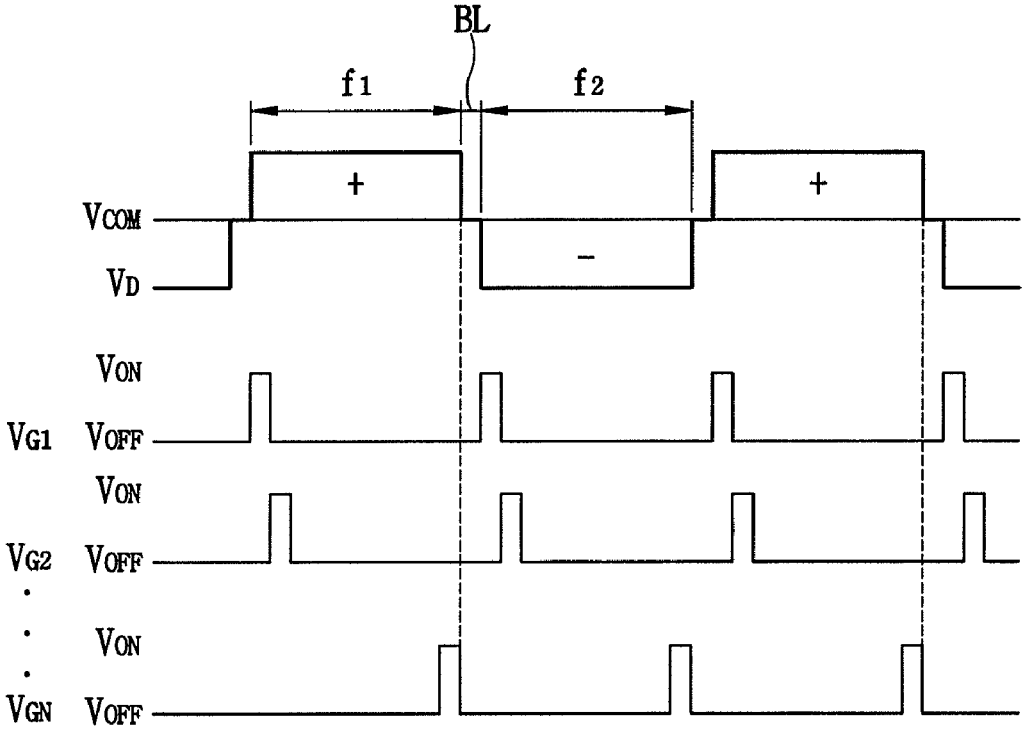
FIG. 7 is waveforms showing a point of time of cutting off outputs of data and gate driving sections.

FIG. 7 is waveforms showing a point of time of cutting off outputs of data and gate driving sections.

Referring to FIGS. 1 and 7, one frame is defined as an interval where one data signal is outputted. Generally, the data driving section 140 outputs 64 number of data signals, so that one frame is about 1/64 second.

A positive data signal Vd with reference to a common voltage Vcom is outputted during a first frame f1, and a negative data signal Vd is outputted during a second frame f2. The first and second frames f1 and f2 alternate with each other. That is, the data driving section 140 outputs the data signal Vd that is reversed per frame.

While the data driving section 140 outputs the data signal Vd by one frame, the gate driving section 150 outputs the gate signals Vg1, Vg2, . . . , Vgn in sequence.

A blank interval BL is interposed between the first and second frames f1 and f2. During the blank interval BL, the gate driving section 150 does not output the gate signal. That is, a gate signal outputted during the first frame f1 is discharged to be removed during the blank interval BL, so that the gate signal is not overlapped with a gate signal that is outputted during the second frame f2.

When the source voltage DVDD applied to the gate driving section 100 may be cut off during the first frame f1 or the second frame f2, and the gate signals Vg1 to Vgn may be outputted during the first frame f1 or the second frame f2, then the gate signals Vg1 to Vgn induce noises that appear as a horizontal line in the display panel.

Thus, when the data driving section 140 is turned off in the blank interval BL during which the gate signals Vg1 to Vgn are not outputted, the noises are removed.

According to the present invention, the first gate driving voltage that turns on the gate driving section drops to be the ground voltage at a point of time when the source voltage is cut off, and the second gate driving voltage that turns off the gate driving section is cut off and raised to be the ground voltage a few seconds later (or after short period of time).

Thus, the noises generated after the source voltage is cut off are removed.

Having described the exemplary embodiments of the present invention and its advantages, it is noted that various changes, substitutions and alterations can be made herein without departing from the spirit and scope of the invention as defined by appended claims.

What is claimed is:

1. A display apparatus comprising:

a display panel including data and gate lines, and displaying an image;

a driving voltage generating section that receives a source voltage to output a gate on voltage, a gate off voltage, and a data driving voltage;

a data driving section generating a data signal by using the data driving voltage and the data driving section outputting the data signal to the data line; and a gate driving section generating a gate signal by using the gate on voltage and the gate off voltage and the gate driving section outputting the gate signal to the gate line, wherein the gate on voltage is discharged to ground before the data signal is cut off, and the gate off voltage is discharged to the ground after the data signal is cut off.

2. The display apparatus of claim 1, further comprising:

a first switching section that switches the source voltage in response to a first switching signal;

a timing control section outputting a gate control signal and a data control signal in response to the source voltage; and a second switching section that switches the gate on voltage, the gate off voltage and the data driving voltage.

3. The display apparatus of claim 2, wherein the first switching section turns off the timing control section at a second time point that is next to a first time point at which the source voltage is cut off so as to control the timing control section to be turned on or off.

4. The display apparatus of claim 3, wherein the second switching section cuts off the gate on voltage at a third time point that is prior to the second time point, and the second switching section cuts off the gate off voltage at a fourth time point that is next to the second time point, so that the gate driving section is controlled to be turned on or off.

5. The display apparatus of claim 4, wherein the gate on voltage is positive, and the gate off voltage is negative.

6. The display apparatus of claim 5, wherein the gate on voltage turns on the gate driving section, and the gate off voltage turns off the gate driving section.

7. The display apparatus of claim 6, wherein the gate on voltage drops to be a ground voltage at the third time point, and the gate off voltage is raised to the ground voltage at the fourth time point.

8. The display apparatus of claim 4, wherein the gate on voltage is negative, and the gate off voltage is positive.

9. The display apparatus of claim 8, wherein the gate on voltage turns on the gate driving section, and the gate off voltage turns off the gate driving section.

10. The display apparatus of claim 9, wherein the gate on voltage is raised to a ground voltage at the third time point, and the gate off voltage drops to the ground voltage at the fourth time point.

11. The display apparatus of claim 3, wherein the data driving voltage is lowered to a ground voltage at the second time point to turn off the data driving section.

12. The display apparatus of claim 11, wherein the data driving section outputs the data signal that is higher than a reference voltage during a first frame, and the data driving section outputs the data signal that is lower than a reference voltage during a second frame, and wherein the gate driving section outputs the gate signal during the first and second frames.

13. The display apparatus of claim 12, wherein a blank interval is interposed between the first and second frames, and the gate signal outputted during the first frame is discharged during the blank interval.

14. The display apparatus of claim 13, wherein the second switching section cuts off the data driving voltage during the blank interval, so that the second time point is disposed in the blank interval.

15. The display apparatus of claim 1, wherein the gate driving section is formed on the display panel.

16. A method of driving a display panel including a data line and a gate line, comprising:

generating a gate on voltage, a gate off voltage, and a data driving voltage from a source voltage;

outputting a data signal generated from the data driving voltage to the data line;

outputting a gate signal generated from the gate on voltage and the gate off voltage to the gate line;

discharging the gate on voltage to ground before the data signal is cut off;

discharging the gate off voltage to the ground after the data signal is cut off; and cutting off output of the data signal.

17. The method of claim 16, wherein the source voltage is cut off at a first time point, and the data signal is cut off at a second time point that is next to the first time point.

18. The method of claim 17, wherein the gate on voltage drops to be the ground at a third time point that is prior to the second time point, and the gate off voltage is raised to the ground at a fourth time point that is next to the second time point.

* * * * *